US006241286B1

(12) United States Patent
Ogura et al.

(10) Patent No.: US 6,241,286 B1
(45) Date of Patent: Jun. 5, 2001

(54) FILE FOLDER

(75) Inventors: Kazuhiko Ogura; Shinichi Fujita, both of Urawa (JP)

(73) Assignee: Teikoku Printing Inks Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/513,080

(22) Filed: Feb. 25, 2000

(30) Foreign Application Priority Data

Sep. 24, 1999 (JP) ..... 11-269976

(51) Int. Cl.[7] ..... B42D 3/00
(52) U.S. Cl. ..... 281/29; 402/79
(58) Field of Search ..... 281/29, 31, 37; 402/79, 73, 70; 283/116; 229/67.1, 68.1, 72; 40/359; 493/947

(56) References Cited

U.S. PATENT DOCUMENTS 5,025,978 * 6/1991 Pacione ..... 402/79 X
5,335,027 * 8/1994 Lin et al. ..... 402/79 X
5,890,774 * 4/1999 Schwartz et al. ..... 40/359
6,019,539 * 2/2000 Lynton ..... 402/79

* cited by examiner

*Primary Examiner*—Willmon Fridie, Jr.
(74) *Attorney, Agent, or Firm*—Oblon, Spivak, McClelland, Maier & Neustadt, P.C.

(57) ABSTRACT

File folder has a pair of sheet materials which are made of a synthetic resin, are connected via a folding line at one of the longer sides, and are heat welded at a shorter side which adjoins the folding line. Substantially throughout an outer surface of one sheet material is formed a receiving layer, that can receive substances which are displaying media such as various printing inks (e.g., UV ink for printing), thermal transcription inks for printers, ink-jet inks, toners for copying machines, oily inks for oily pens, water-color inks for water-color pens, core materials for pencils, stamp inks for stamps, and cinnabar seal inks.

6 Claims, 2 Drawing Sheets

FILE FOLDER

BACKGROUND OF THE INVENTION

1. Field of the Invention

The present invention relates to a file folder which can holds various kinds of documents.

2. Description of the Related Art

Nowadays a simple file folder which can hold documents is widely used for various kinds of desk work and so on. This file folder has a pair of rectangular sheet materials, which are connected via a folding line at a longer side, and a pair of shorter sides which adjoin said longer side are welded to each other. Therefore, documents can be inserted through the other (open) longer and shorter sides into a gap between both sheet materials to be held.

Conventional file folders are made of synthetic resins to observe documents which are held, and to keep durability, so that users can not draw their favorite designs or write texts concerning the documents on their surfaces to arbitrarily and visually record the content of the documents.

SUMMARY OF THE INVENTION

The present invention was conceived in order to solve the conventional problems, and the purpose is to provide a file folder which is made of a synthetic resin, and which allows arbitrary and visual recording on its surface.

To solve the above-mentioned problem, the present invention provides a file folder which is made of a synthetic resin, and has a pair of sheet materials which are connected each other, and are opposed to each other, which documents are held between the inner surfaces of said sheet materials, wherein a receiving layer which can receive substances which are displaying media such as inks is formed on at least one of the outer surfaces of said pair of sheet materials.

The above-mentioned sheet materials can be made of a synthetic resin such as polyethylene, polypropylene, a polyester, a polycarbonate, and polymethacrylate. The displaying media include various printing inks such as UV inks for printing, heat transcription inks and ink-jet inks for printers, toners for copying machines, oily inks for oil pens, water-color inks for water-color pens, core materials for pencils, stamp inks for stamps, and cinnabar seal inks.

A receiving layer which can receive materials for these displaying media is formed, for example, with a resin layer which contains both large particle size sponge silica having a particle size of 8–18 μm and small particle size sponge silica having a particle size of 1–7 μm. The term "sponge silica" in the present invention means the silica which has pores in a silica particle, i.e., "sponge structure".

The pore volume of the sponge silica is preferably 0.7–7 ml/g, more preferably 0.8–4 ml/g. If the pore volume of the sponge silica is too small, the record-receiving property of the receiving layer tends to become low. If the pore volume of the sponge silica is too large, the viscosity of the resin liquid which consists of the receiving layer tends to become too high to coat for forming the receiving layer.

The resin liquid includes resin solutions, resin emulsions, molten hot-melt resins, two-liquid curing type unreacted resin liquids, UV-light-curing type unreacted resin liquids, and so on. The procedures to cure the resin liquid after coating or printing on a sheet material include evaporation of solvents or dispersants, cooling, heating, UV-light irradiation, and so on, depending on each case.

The large particle sponge silica has a particle size of 8–18 μm as mentioned above. If only the large particle sponge silica is used, the silica is sedimented in the resin liquid, and the quality of the receiving layer tends to become uneven, and such a disadvantage can occur that the friction-resistance of the receiving layer is lowered and so on. If only the small particle sponge silica having a particle size of 1–7 μm is used, the receiving performance is lowered so that it is impossible to achieve the purpose of the present invention.

The 'small particle sponge silica'/'large particle sponge silica' weight ratio is preferably 0.1–5 or so. By using such a ratio, it becomes easy to counterbalance disadvantages of both sponge silicas, and to make the best use of their advantages.

With respect to the relation between the amount of the sponge silica and the amount of the resin, it is preferable that the resin/'sponge silica' weight ratio is 0.15–1.5. If the ratio is too small, the resistance against friction of the receiving layer will be lowered. If the ratio is too large, the receiving property of the receiving layer will be lowered.

The above-mentioned receiving layer can be formed by printing with a UV-light-curable ink containing a liquid water-soluble monomer, a hydrophobic polymer which is soluble in the monomer, and a filler having an average particle size of 0.1 μm–30 μm, followed by curing with UV-light. The term "liquid water-soluble monomer" in the present invention means a polymerizable monomer, which can be freely dissolved in water at a normal temperature, such as a (meth)acrylic acid ester of a polyhydric alcohol, a (meth)acrylic acid ester of an N-alkylaminoalcohol, a polyethylene glycol (meth)acrylate, an N-alkyl (meth)acrylic acid amide, and a vinyl ether of a polyhydric alcohol.

The liquid water-soluble monomer also includes butanediol monoacrylate, 2-hydroxyethyl acrylate, N,N-diethylaminoethyl methacrylate, N,N-dimethylaminoethyl acrylate, N,N-dimethylaminoethyl methacrylate, N,N-dimethylacrylamide, acryloylmorpholine, 2-hydroxyethyl vinyl ether, and the like. A mixture of these monomers can also be used.

Two criteria should be considered upon the selection of a polymer. The first criterion is that a polymer is dissolved in the above-mentioned water-soluble monomer or a mixture consisting of 100 pts. wt. of a water-soluble monomer and 80 pts. wt. or less of a non-water-soluble monomer. The second criterion is that, in case a film is produced with a polymer and is soaked in water at 25° C. for two hours, 100 g of the polymer does not absorb 10 g or more of water, or the polymer does not substantially dissolve in the water.

Hydrophobic polymers which satisfy the above-mentioned two criteria include an alkyl (meth)acrylate (co) polymer, 'vinyl chloride'-'vinyl acetate' copolymer, a polyester, cellulose acetate, cellulose propionate, cellulose acetate butyrate, nitrocellulose, butyral resin, and the like. Preferable ones are cellulose derivatives such as cellulose acetate, cellulose propionate, and cellulose acetate butyrate.

The polymer is added to the liquid water-soluble monomer at a polymer/'liquid water-soluble monomer' weight ratio of preferably 0.03–0.8, more preferably 0.05–0.6. If the ratio is smaller than the ranges, the sticking and welding properties of a toner or thermal transcription ink coating film when the obtained receiving layer is printed by thermal transcription and the water-resistance can become low. If polymer is not added, the storage stability and the printability of the ink is extremely bad. If the ratio is larger than the ranges, the transcription of a toner or thermal transcription ink coating film can become bad, and clear images are hardly obtained.

A filler which can be used for the present invention include well known fillers such as silica, talc, clay, zeolite, calcium carbonate, calcium silicate, magnesium carbonate, barium sulfate, mica, synthetic mica, diatomaceous earth, aluminum hydroxide, alumina, and titanium oxide. Judging from the receiving property, water-resistance, and brightness, preferable fillers include silica, synthetic mica, aluminum hydroxide, and alumina. The average particle size of the filler is preferably 0.1–30 μm, more preferably 0.2–15 μm.

When designs which are favorable for a user and/or information concerning documents which are held are added to the receiving layer which was thus formed on the outer surface of the sheet material, the designs and/or information are attached according to the following procedure: 1) the designs and/or information are put into a personal computer, 2) the file folder is set in a printer, 3) the receiving layer is printed, and 4) inks are received in the receiving layer.

It is also possible to copy the designs and the like on the receiving layer using a copying machine, and to draw them using water-color inks, oily inks, or pencils.

With respect to the file folder of the present invention, the above-mentioned pair of sheet materials is connected via a folding line at one side, and they are joined at another side which adjoins the folding line. The remaining adjacent two sides are not joined (i.e., open). Documents and the like can be inserted through the open two sides to be held.

The file folder of the present invention has (A) a pair of sheet materials which are made of a synthetic resin, and are bendably connected to each other via a folding line at one side, (B) a receiving layer which is formed on the outer surface of at least one of the outer surfaces of the above-mentioned pair of sheet materials, and can receive substances which are displaying media such as inks, and (C) an adhesion material which is on one inner surface of one of the above-mentioned pair of sheet materials, is formed along a side which adjoins the above-mentioned folding line, and can adhere to a corresponding material of the other sheet material which is bent along the above-mentioned folding line.

With respect to the file folder of the present invention, a pair of sheet materials is connected by folding along a folding line at one side, and they are joined at another side which adjoins the folding line, so that the joined part can interfere with the paper-feeding mechanism of a printer, irregular running or so called "paper-clogging" can occur, and fine printing could become impossible. Therefore, a pair of sheet materials which were bendably connected is set in a printer without bending according to the present invention. This setting allows fine printing without causing irregular running or so called "paper-clogging".

After printing, the pair of the sheet materials is folded along the folding line, and then both sheet materials are adhered ti each other at the adhesion part. Thus, a file folder in which a pair of sheet materials is connected along a folding line at one side, and is adhered to each other at another side which adjoins the folding line, is formed.

With respect to a file folder of the present invention, the above-mentioned adhesion part is an adhesion layer which is prepared by applying an adhesive, and said layer has a sheet of attached peelable paper on it. Therefore, printing can be performed without trouble with the adhesion layer not touching the paper-feeding mechanism when printed in a printer. After printing, the sheet of peelable paper is removed, a pair of sheet materials is folded along a folding line, and both sheet materials are adhered to each other in the adhesion part. Thus, a file folder in which a pair of sheet materials is folded along a folding line at one side, and is adhered to each other along another side which adjoins the folding line, is formed.

The adhesion layer consists, for example, of an acrylic ester (co)polymer, a vinyl acetate (co)polymer, a rubber-based adhesive, and the like. The adhesion layer can be formed 1) by applying an emulsion of an adhesive containing globules having a particle size of 2–100 μm onto a substrate, followed by drying, or 2) by applying a radiation-curable ink on a substrate, followed by radiation. The adhesion layer which is prepared by the latter method is weakly adhesive, and sheet materials which were adhered to each other can be peeled off again. Therefore, sheet materials which were adhered to each other can be peeled again, and be printed in a printer again.

The application can be carried out by the screen printing, the offset printing, the gravure, the aniline process, the typography, the roll coat, the spray coat, and the like; most preferably by the screen printing which allows formation of a thick adhesion layer. The thickness of the adhesion layer is preferably 4 μm or larger, more preferably 10 μm or larger in view of repeelability and adhesion stability.

A file folder of the present invention can receive prints by a printer, so that, as described before, designs and information can be put into a personal computer, the file folder is set in the printer, the receiving layer can be printed, and ink(s) can be received on the receiving layer, so that designs and/or information can be added.

DESCRIPTION OF THE PREFERRED EMBODIMENT

Figure 1:
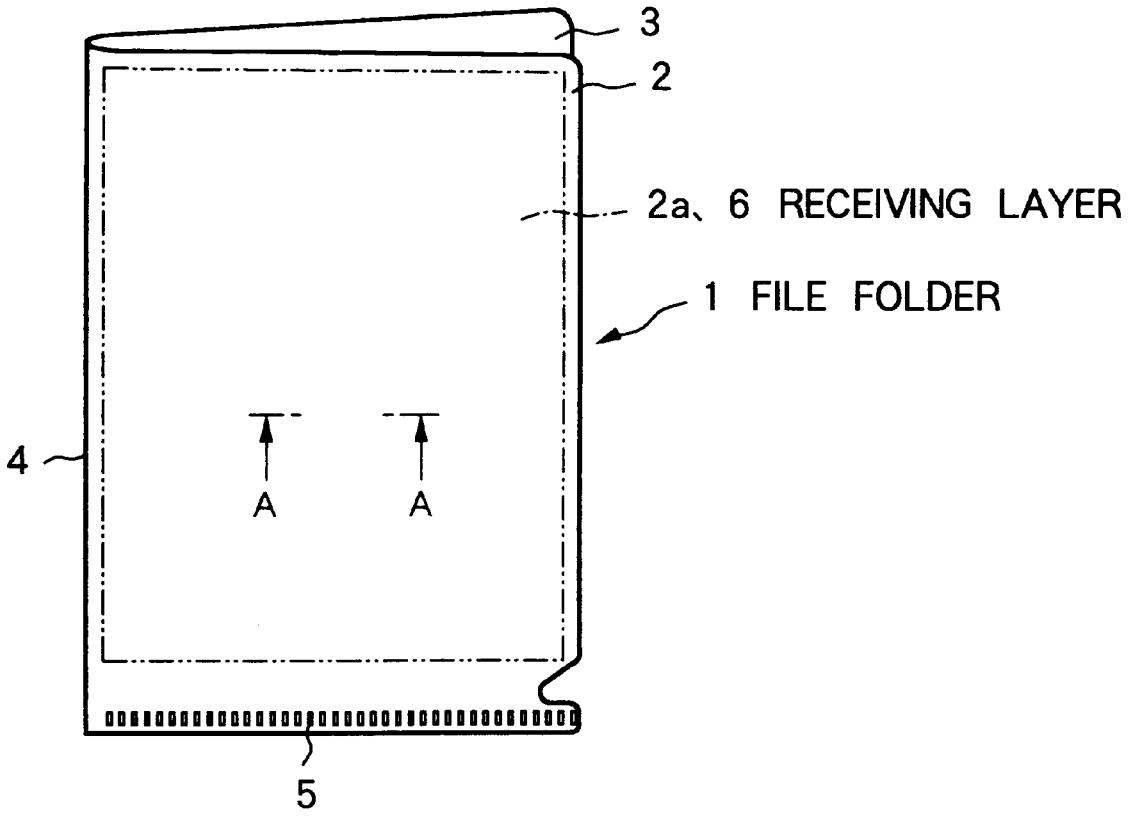
FIG. 1 illustrates a perspective view of a file folder according to the first embodiment of the present invention.
Figure 2:
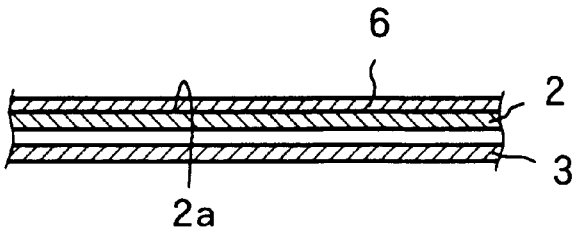
FIG. 2 illustrates a cross section, along line A—A of FIG. 1, of a file folder according to the first embodiment of the present invention.

Embodiments of the present invention will be presented below FIGS. 1 and 2 illustrate the first embodiment of the present invention. File folder 1 has a pair of sheet materials 2 and 3 which are folded, and are opposed to each other. The sheet materials 2 and 3 are rectangular, and are made of a synthetic resin such as polyethylene, polypropylene, a polyester, a polycarbonate, and polymethacrylate, and and transparent or translucent. The sheet materials 2 and 3 are connected by folding along a folding line 4 at a longer side, and they are heat welded in adhesion to part 5 along a shorter side.

On outer surface 2*a* of one sheet material 2, receiving layer 6 is formed substantially throughout the surface. Receiving layer 6 is formed by coating an agent which consists of 50 pts. wt. of sponge silica having a pore volume of 1.9 ml/g and an average particle size of 11 μm, 50 pts. wt. of sponge silica having a pore volume of 1.7 ml/g and an average particle size of 5 μm, and 500 pts. wt. of an emulsion which contains acrylic resin at 10 wt. %, onto outer surface 2*a* of sheet material 2, followed by thermally evaporating the water. Therefore receiving layer 6 has a property which can receive materials which are displaying media such as UV inks for printing, thermal transcription inks for printers, ink-jet inks, toners for copying machines, oily inks for oily pens, water-color inks for water-color pens, core materials for pencils, stamp inks for stamps, and cinnabar seal inks.

In the embodiment of the present invention having the above-mentioned constitution, when a user of file folder 1 adds to receiving layer 6 favorite designs and/or information concerning the documents which are held between both sheet materials 2 and 3, those designs and/or information are put into a personal computer previously mentioned. Then, the file folder is set in a printer, with receiving layer 6 being the surface to be printed, and printing is started. Thus, receiving layer 6 receives ink(s) from the printer, designs and/or information are printed, and file folder 1 can be prepared with favorite designs and/or necessary information printed on receiving layer 6.

It is also possible to copy designs and the like on receiving layer 6 using a copying machine, or to draw designs and the like using aqueous pens, oily pens, or pencils. When file folder 1 is used, documents and the like are inserted to be held between a pair of sheet materials through the two open sides.

Receiving layer 6 can also be formed by blending raw materials using a mixer at weight ratios shown in Examples 1–4 in Table 1 (below) to produce light-curable receiving inks, which are then screen printed on outer surface 2*a* of sheet material 2, followed by the UV-radiation.

TABLE 1

| | Examples | | | |
|---|---|---|---|---|
| | 1 | 2 | 3 | 4 |
| Cellulose acetate *1 | 4.0 | | 4.0 | |
| Polyvinylbutyral *1 | | 4.0 | | 4.0 |
| Acryloylmorfoline *2 | 36.0 | 36.0 | 36.0 | 36.0 |
| Methoxypolyethyleneglycol acrylate *2 | 25.0 | 25.0 | 25.0 | 25.0 |
| Olygourethane diacrylate *3 | 4.5 | 4.5 | 4.5 | 4.5 |
| Photopolymerization initiator | 5.0 | 5.0 | 5.0 | 5.0 |
| Cowhide fiber powder | 23.5 | 23.5 | | |
| Silica | | | 23.5 | 23.5 |
| Antifoam and dispersant | 2.0 | 2.0 | 2.0 | 2.0 |

Figure 3:
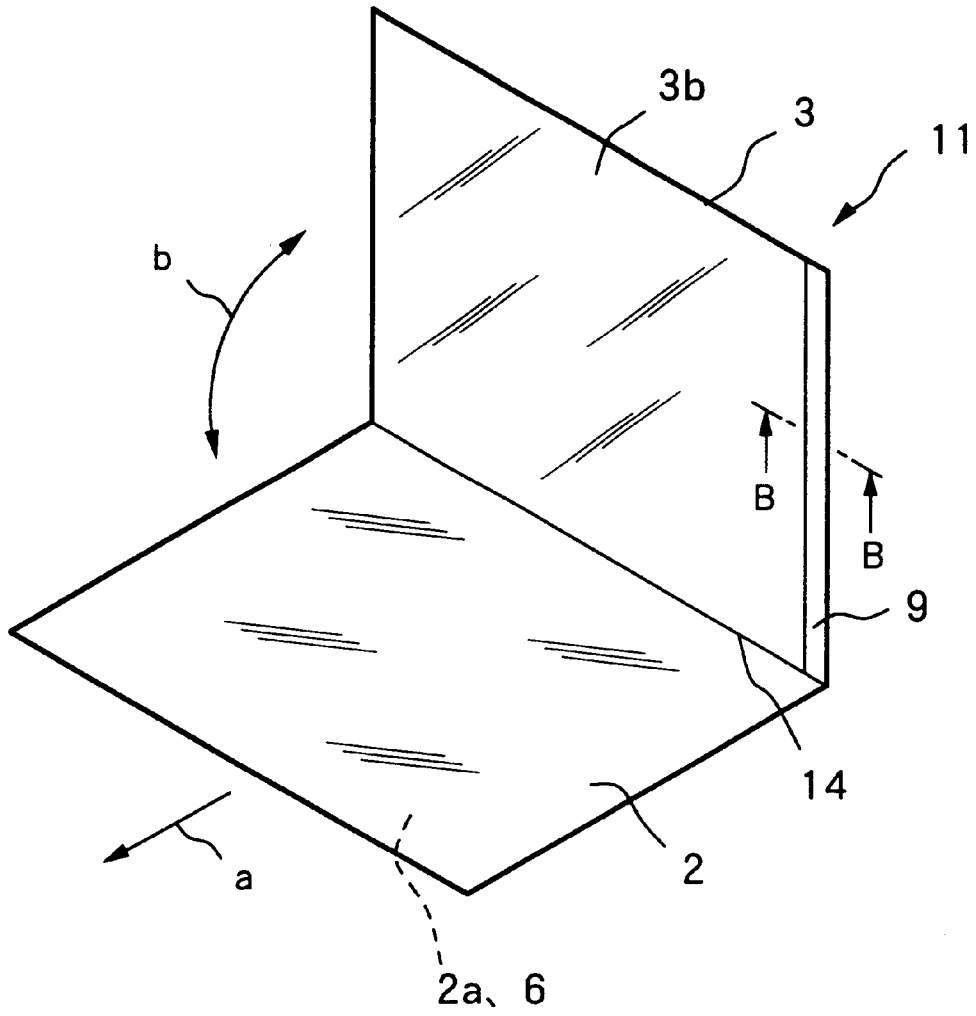
FIG. 3 illustrates a perspective view of a file folder according to the second embodiment of the present invention.
Figure 4:
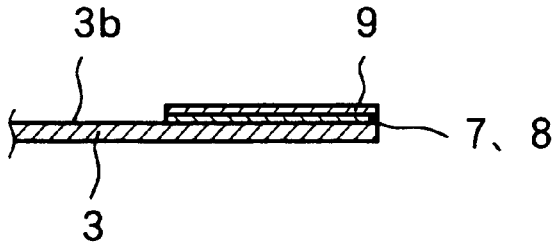
FIG. 4 illustrates a cross section, along line B—B of FIG. 3, of a file folder according to the second embodiment of the present invention.

*1 Monomer-soluble hydrophobic polymer
*2 Liquid water-soluble monomer
*3 Monomer-soluble polymerizable oligomer FIGS. 3 and 4 illustrate the second embodiment of the present invention. File folder 11 has a pair of sheet materials 2 and 3 which are connected via a folding line 14. Sheet materials 2 and 3 have forms which are similar to ones which were described in the above-mentioned embodiment, and are made of a synthetic resin. On outer surface 2*a* of one sheet material 2, receiving layer 6 which is similar to one which was described in the above-mentioned embodiment is formed substantially throughout the surface (see FIG. 4).

On inner surface 3*b* of the other sheet material 3, there is provided adhesion layer 8 forming adhesion part 7 along a side which adjoins the above-mentioned folding line 14. Adhesion layer 8 consists of an 'acrylic acid ester'-'vinyl acetate' (co)polymer, a rubber-based adhesive, and the like. On the surface, there is peelably attached a sheet of peelable paper 9.

In the embodiment having the above-mentioned constitution of the present invention, when favorite designs and the like are added to receiving layer 6 using a printer, the designs and the like are put in a personal computer previously mentioned. Then, for example, as arrow "a" in FIG. 3 shows, the file folder is set in a printer from the side of sheet material 2, with receiving layer 6 being the surface to be printed, and printing is started. Thus, receiving layer 6 receives ink(s) from the printer, and the designs and so on are printed.

When printed, in the case of file folder 1 shown in the first above-mentioned embodiment, a pair of sheet materials 2 and 3 is folded, and they are heat welded to each other at the shorter side in the connection part 5, so that connection part 5 can interfere with the paper-feeding mechanism, and can cause irregular running or so called "paper clogging", and fine prints could become impossible. With respect to file folder 11 in the second embodiment, however, sheet materials 2 and 3 pass through a printer separately, and they have no folded part, so that irregular running or so called "paper clogging" does not occur. As peelable paper 9 is attached on the surface of the adhesion layer 8, the adhesion layer 8 does not come in contact with the paper-feeding mechanism of a printer. Therefore, printing can be performed without trouble, and fine prints become possible.

After printing, peelable paper 9 is removed, sheet materials 2 and 3 are folded along folding line 14 (FIG. 3, arrow b), and the surface of the adhesion layer 8 is adhered with the corresponding part of the inner surface of sheet material 2. Thus, file folder 11 which is connected along folding line 14 at one side, and is joined via adhesion layer 8 at another side which adjoins folding line 14, is formed. When file folder 11 is used, documents and so on can be inserted through the two open sides of sheet materials 2 and 3 to be held.

Although the strongly adhesive adhesion layer 8 such as a rubber-based adhesive was described in the second embodiment, a weakly adhesive adhesion layer 8 can also be used which can be peeled from the corresponding part of the inner surface of sheet material 2. In this case, adhered sheet material 2 can be peeled from sheet material 3 again, and can be printed again in the printer.

Although receiving layer 6 is formed only on one sheet material 2 of a pair of sheet materials 2 and 3 in the above-mentioned embodiment, receiving layer 6 can be formed on both sheet materials 2 and 3, or on only parts of sheet materials 2 and 3. Receiving layer 6 can consist not only of the components shown in the above-mentioned embodiment, but also of well known components.

As described above, as the file folder according to the present invention is made of a synthetic resin, holds documents between a pair of sheet materials, and has a receiving layer which can receive a substance which is a displaying medium such as inks on its outer surface of the sheet material, users of the file folder can arbitrarily and visually add their favorite designs and/or information concerning the documents to be held.

In addition, a file folder according to the present invention has a receiving layer which can receive a substance which is a displaying medium such as inks is formed on the outer surface of a pair of sheet materials which are made of a synthetic resin, and are connected along a folding line, and an adhesion part which, in the inner surface of one of the sheet materials, can adhere to the corresponding part of the other sheet along the side which adjoins the above-mentioned folding line. Therefore, the file folder can be printed in a printer, with a pair of sheet materials unfolding, without causing irregular running or so called "paper clogging", thus allowing fine printing. After the printing, a pair of sheet materials is folded along a folding line, and then both sheet materials are adhered to each other in the adhesion part, so that a file folder can be formed with a pair of sheet materials folded along a folding line, and the sheet materials are adhered along the side which adjoins the folding line. Thus, a file folder can be obtained which allows fine printing, and in which one side and an adjacent side are closed.

What is claimed is:

1. A file folder for holding documents, comprising:

a pair of sheet materials which arc connected to each other via a folding line at one long side and are joined to each other at another side which adjoins the folding line, said sheet materials having inner surfaces between which the documents are to be held;

a receiving layer formed substantially throughout an outer surface of at least one of the pair of sheet materials and configured to receive a displaying medium; and a connection part having two short sides, one of which adjoins the folding line, and also having two long sides, at least one of which connects the sheet materials to each other at one short side of the sheet materials.

2. A file folder according to claim 1, wherein the sheet materials are made of a synthetic resin and the displaying medium is an ink.

3. A file folder according to claim 1, wherein the receiving layer is a coating of an agent of sponge silica and an emulsion which contains acrylic resin, said coating having any water thermally evaporated therefrom.

4. A file folder according to claim 1, wherein the receiving layer is a blend of raw materials producing a light-curable receiving ink screen-printed onto said outer surface after ultraviolet radiation.

5. A file folder according to claim 1, wherein the connection part is an adhesive strip formed on an inner surface along an edge of one of the pair of sheet materials and adherable to a corresponding part of the other of the pair of sheet materials.

6. A file folder according to claim 5, further comprising:

a sheet of paper peelably attached onto the adhesive strip.

* * * * *

UNITED STATES PATENT AND TRADEMARK OFFICE

CERTIFICATE OF CORRECTION

PATENT NO. : 6,241,286 B1
DATED : June 5, 2001
INVENTOR(S) : Kazuhiko Ogura et al.

It is certified that error appears in the above-identified patent and that said Letters Patent is hereby corrected as shown below:

Title page,
ABSTRACT,
Line 5, after "material" insert -- there --.
Line 5, change ",that" to -- which --.
Line 6, change "which" to -- that --. (first occurrence)

Column 1,
Line 30, after "connected" insert -- to --.

Column 2,
Lines 44-45, change "100 g" to -- 100g --.
Lines 48-49, change "(co) polymer" to -- (co)polymer --.

Column 3,
Line 53, change "ti" to -- to --.

Column 4,
Line 33, change "A—A" to -- A-A --.
Line 39, change "B—B" to -- B-B --.
Line 47, after "below" insert a period.
Line 52, change "and" (third occurrence) to -- are --.
Line 64, after "onto" insert -- the --.
Line 66, after "Therefore" insert a comma.

Column 5,
Line 11, after "folder" insert -- 1 --.

UNITED STATES PATENT AND TRADEMARK OFFICE

CERTIFICATE OF CORRECTION

PATENT NO. : 6,241,286 B1
DATED : June 5, 2001
INVENTOR(S) : Kazuhiko Ogura et al.

It is certified that error appears in the above-identified patent and that said Letters Patent is hereby corrected as shown below:

Column 6,
Line 4, after "folder" insert -- 11 --.

Signed and Sealed this

Second Day of April, 2002

*Attest:*

*Attesting Officer*

JAMES E. ROGAN
*Director of the United States Patent and Trademark Office*